US007470358B1

(12) United States Patent
Kalnes

(10) Patent No.: US 7,470,358 B1
(45) Date of Patent: Dec. 30, 2008

(54) INTEGRATED PROCESS FOR THE PRODUCTION OF LOW SULFUR DIESEL

(75) Inventor: Tom N. Kalnes, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 285 days.

(21) Appl. No.: 11/311,049

(22) Filed: Dec. 19, 2005

(51) Int. Cl.
*C10G 45/04* (2006.01)
*C10G 47/02* (2006.01)

(52) U.S. Cl. ..... 208/89; 208/58; 208/59; 208/108; 208/209; 208/212

(58) Field of Classification Search ..... 208/89, 208/58, 59, 108, 209, 212
See application file for complete search history.

(56) References Cited

U.S. PATENT DOCUMENTS 5,403,469 A 4/1995 Vauk et al. ..... 208/78
5,720,872 A 2/1998 Gupta ..... 208/57
5,958,218 A * 9/1999 Hunter et al. ..... 208/78
6,190,535 B1 2/2001 Kalnes et al. ..... 208/89
6,200,462 B1 * 3/2001 Cash et al. ..... 208/89
6,623,623 B2 * 9/2003 Kalnes ..... 208/89
7,097,760 B1 * 8/2006 Kalnes et al. ..... 208/108
7,384,542 B1 * 6/2008 Thakkar et al. ..... 208/213
2006/0186022 A1 * 8/2006 Kalnes ..... 208/97

* cited by examiner

*Primary Examiner*—Tam M Nguyen
(74) *Attorney, Agent, or Firm*—James C Paschall

(57) ABSTRACT

An integrated process for the production of low sulfur diesel. The process utilizes a middle distillate hydrocarbon stream and a heavy distillate hydrocarbon stream. The middle distillate hydrocarbon feedstock is reacted with a hydrogen rich gaseous stream having a first pressure in a hydrodesulfurization reaction zone and the heavy distillate hydrocarbon feedstock is reacted with a hydrogen rich gaseous stream having a second pressure in a hydrocracking zone.

17 Claims, 1 Drawing Sheet

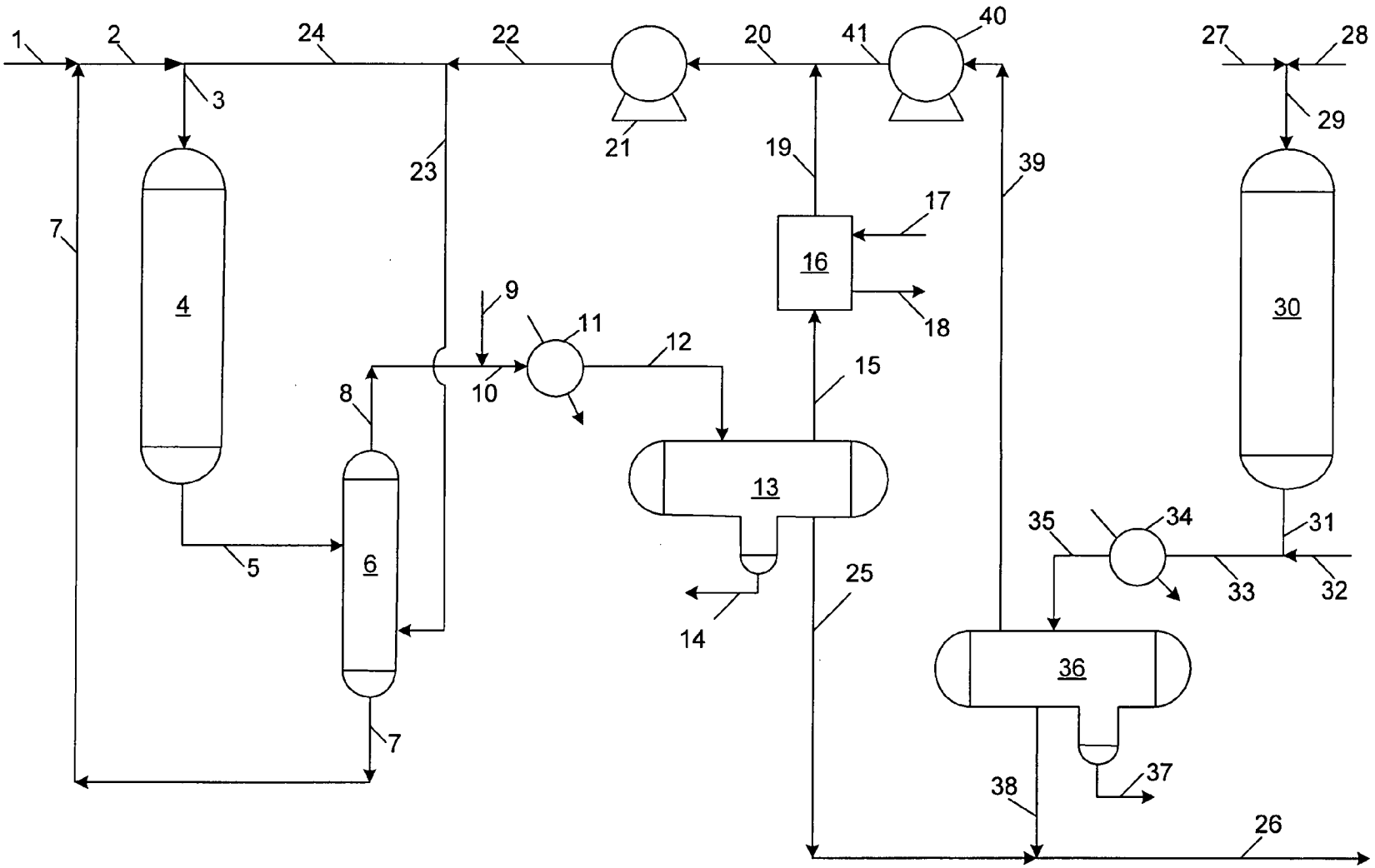
1
2
3
4
5
6
7
7
8
9
10
11
12
13
14
15
16
17
18
19
20
21
22
23
24
25
26
27
28
29
30
31
32
33
34
35
36
37
38
39
40
41

INTEGRATED PROCESS FOR THE PRODUCTION OF LOW SULFUR DIESEL

FIELD OF THE INVENTION

The field of art to which this invention pertains is the catalytic conversion of two hydrocarbon feedstocks to produce useful hydrocarbon products by hydrocracking and hydrodesulfurization.

BACKGROUND OF THE INVENTION

Petroleum refiners produce desirable products such as turbine fuel, diesel fuel and other products known as middle distillates, as well as lower boiling hydrocarbonaceous liquids, such as naphtha and gasoline, by hydrocracking a hydrocarbon feedstock derived from crude oil or heavy fractions thereof. Feedstocks most often subjected to hydrocracking are gas oils and heavy gas oils recovered from crude oil by fractionation. A typical heavy gas oil comprises a substantial portion of hydrocarbon components boiling above about 371° C. (700° F.), usually at least about 50% by weight boiling above 371° C. (700° F.). A typical vacuum gas oil normally has a boiling point range between about 315° C. (600° F.) and about 565° C. (1050° F.).

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen to yield a product containing a distribution of hydrocarbon products desired by the refiner.

Refiners also subject middle distillate hydrocarbon streams to hydrodesulfurization to produce ultra low sulfur diesel and other hydrocarbon streams having a reduced concentration of sulfur. Although a wide variety of process flow schemes, operating conditions and catalysts have been used in commercial activities, there is always a demand for new hydroprocessing methods which provide lower costs, more valuable product yields and improved operability.

Information Disclosure

U.S. Pat. No. 5,403,469 B1 (Vauk et al.) discloses a parallel hydrotreating and hydrocracking process. Effluent from the two processes are combined in the same separation vessel and separated into a vapor comprising hydrogen, and a hydrocarbon containing liquid. The hydrogen is shown to be supplied as part of the feed streams to both the hydrocracker and the hydrotreater.

U.S. Pat. No. 5,720,872 B1 (Gupta) discloses a process for hydroprocessing liquid feedstocks in two or more hydroprocessing stages which are in separate reaction vessels and wherein each reaction stage contains a bed of hydroprocessing catalyst. The liquid product from the first reaction stage is sent to a low pressure stripping stage stripped of hydrogen sulfide, ammonia and other dissolved gases. The stripped product stream is then sent to the next downstream reaction stage, the product from which is also stripped of dissolved gases and sent to the next downstream reaction stage until the last reaction stage, the liquid product of which is stripped of dissolved gases and collected or passed on for further processing. The flow of treat gas is in a direction opposite the direction in which the reaction stages are staged for the flow of liquid. Each stripping stage is a separate stage, but all stages are contained in the same stripper vessel.

U.S. Pat. No. 6,190,535 B1 (Kalnes et al.) discloses a catalytic hydrocracking process wherein the effluent from the hydrocracking zone is passed into a hot, high pressure stripper. At least a portion of the unconverted feed is recycled to the hydrocracking zone.

BRIEF SUMMARY OF THE INVENTION

The present invention is an integrated process for the production of low sulfur diesel. The process of the present invention utilizes a middle distillate hydrocarbon stream and a heavy distillate hydrocarbon stream. The middle distillate hydrocarbon feedstock is reacted with a hydrogen rich gaseous stream having a first pressure in a hydrodesulfurization reaction zone and the heavy distillate hydrocarbon feedstock is reacted with a hydrogen rich gaseous stream having a second pressure in a hydrocracking zone.

The use of lower pressure hydrogen in a hydrodesulfurization reaction zone and a higher pressure of hydrogen gas in the hydrocracking zone results in the integration of two hydroprocessing units utilizing the same make-up hydrogen which minimizes the requirement for compression equipment and thereby reduces the investment and operating costs for processing two separate and independent hydrocarbon feedstocks.

Other embodiments of the present invention encompass further details, such as detailed descriptions of feedstocks, hydrodesulfurization catalysts, hydrocracking catalysts and preferred operating conditions, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not to be a limitation thereof.

DETAILED DESCRIPTION OF THE INVENTION

The present invention is an integrated process for the hydrodesulfurization of middle distillate hydrocarbon streams and the hydrocracking of heavy distillate hydrocarbon streams. Preferred feedstocks to the hydrodesulfurization reaction zone include distillate hydrocarbons boiling at a temperature greater than about 149° C. (300° F.) and more preferably boiling in the range from about 149° C. (300° F.) to about 399° C. (750° F.). Middle distillate hydrocarbon feedstocks are most often recovered from crude oil by distillation. However, middle distillate hydrocarbons may be utilized from any convenient source such as tar sand extract and gas to liquids for example. Furthermore, the middle distillate hydrocarbon feedstocks may contain from about 0.1 to about 4 weight percent sulfur.

The integrated process of the present invention is particularly useful for hydrocracking a hydrocarbon oil containing hydrocarbons and/or other organic materials to produce a product containing hydrocarbons and/or other organic materials of lower average boiling point and lower average molecular weight. The hydrocarbon feedstocks that may be subjected to hydrocracking by the method of the invention include all mineral oils and synthetic oils (e.g., shale oil, tar sand products, etc.) and fractions thereof. Illustrative hydrocarbon feedstocks include those containing components boiling above 288° C. (550° F.), such as atmospheric gas oils, vacuum gas oils, deasphalted, vacuum, and atmospheric residua, hydrotreated or mildly hydrocracked residual oils, coker distillates, straight run distillates, solvent-deasphalted oils, pyrolysis-derived oils, high boiling synthetic oils, cycle oils and cat cracker distillates. A preferred hydrocracking feedstock is a gas oil or other hydrocarbon fraction having at least 50% by weight, and most usually at least 75% by weight, of its components boiling at a temperature above about 288° C. (550° F.). One of the most preferred gas oil feedstocks will contain hydrocarbon components which boil above 288° C. (550° F.) with best results being achieved with feeds containing at least 25 percent by volume of the components boiling between 315° C. (600° F.) and 565° C. (1050° F.).

In one embodiment of the present invention, a heavy distillate hydrocarbon feedstock is introduced into a hydrocracking zone. The hydrocracking zone may contain one or more beds of the same or different catalyst. In one embodiment the preferred hydrocracking catalysts utilize amorphous bases or low-level zeolite bases combined with one or more Group VIII or Group VIB metal hydrogenating components. In another embodiment the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms. It s preferred to employ zeolites having a silica/alumina mole ratio between about 3 and 12. Suitable zeolites found in nature include, for example, mordenite, stillbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms, wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 371'-648° C. (700°-1200° F.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the heavy distillate hydrocarbonaceous feedstock in contact with a hydrocracking catalyst is conducted in the presence of hydrogen at a pressure greater than the pressure in the hydrodesulfurization zone and preferably at hydrocracking reactor conditions which include a temperature from about 260° C. (500° F.) to about 426° C. (800° F.), a pressure from about 7.0 MPa (1000 psig) to about 17.3 MPa (2500 psig), a liquid hourly space velocity (LHSV) from about 0.1 to about 30 $hr^{-1}$, and a hydrogen circulation rate from about 2000 (337 normal $m^3/m^3$) to about 25,000 (4200 normal $m^3/m^3$) standard cubic feet per barrel. The hydrocracking pressure is preferably maintained at a pressure at least 50 percent higher than the integrated hydrodesulfurization zone.

The resulting effluent from the hydrocracking zone is introduced into a hot, high pressure stripper operated at a pressure and temperature substantially equal to the hydrocracking zone to provide a vaporous stream containing hydrocarbonaceous compounds and hydrogen, and a liquid hydrocarbonaceous stream containing unconverted hydrocarbons boiling in the range of the feedstock which stream is recycled to the hydrocracking zone. The vaporous stream containing hydrocarbonaceous compounds is preferably contacted with an aqueous stream to dissolve ammonium salts and partially condensed, and then introduced into a high pressure vapor-liquid separator operated at a pressure substantially equal to the hydrocracking zone and a temperature in the range from about 38° C. (100° F.) to about 71° C. (160° F.). An aqueous stream is recovered from the vapor-liquid separator. A hydrogen-rich gaseous stream is removed from the vapor-liquid separator to provide at least a majority and preferably all of the hydrogen introduced into the hydrocracking zone.

In one embodiment of the present invention, a distillate hydrocarbon boiling at a temperature greater than about 149° C. (300° F.) is introduced into a hydrodesulfurization reaction zone together with a hydrogen-rich make-up stream having a pressure lower than the pressure maintained in the hydrocracking zone at hydrodesulfurization reaction conditions. Preferred hydrodesulfurization reaction conditions include a temperature from about 260° C. (500° F.) to about 426° C. (800° F.), a pressure from about 7.0 MPa (1000 psig) to about 10.5 MPa (1500 psig), and a liquid hourly space velocity from about 0.1 hr-1 to about 10 $hr^{-1}$.

Suitable desulfurization catalysts for use in the present invention are any known convention desulfurization catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable desulfurization catalysts include zeolitic catalysts, as well as noble metal catalysts where the noble metal is selected from palladium and platinum. It is within the scope of the present invention that more than one type of desulfurization catalyst be used in the same reaction vessel. Two or more catalyst beds and one or more quench points may be utilized in the reaction vessel or vessels. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

Referring now to the drawing, a vacuum gas oil feedstock is introduced into the process via line 1 and is admixed with a hydrocarbonaceous recycle stream provided via line 7 and the resulting admixture is carried via line 2 and is joined by a hydrogen-rich recycle gas stream provided via line 24 and the resulting admixture is carried via line 3 and introduced into hydrocracking reaction zone 4. A resulting effluent from hydrocracking reaction zone 4 is carried via line 5 and introduced into hot vapor liquid stripper 6. An unconverted hydrocarbonaceous stream is removed from hot vapor liquid stripper 6 via line 7 and recycled to the hydrocracking reaction zone 4 via line 7, 2 and 3 as described hereinabove. A vaporous hydrocarbonaceous stream containing hydrogen is removed from hot vapor liquid stripper 6 via line 8 and is contacted with an aqueous stream provided via line 9 and the resulting admixture is carried via line 10 and introduced into heat exchanger 11. A resulting cooled and partially condensed stream is removed from heat exchanger 11 via line 12 and introduced into cold vapor liquid separator 13. An aqueous stream containing inorganic compounds is removed from cold vapor liquid separator 13 via line 14 and recovered. A hydrogen-rich gas containing hydrogen sulfide is removed from cold vapor liquid separator 13 via line 15 and introduced into absorption zone 16. A lean amine absorption solution is introduced via line 17 into absorption zone 16 and a rich amine solution containing hydrogen sulfide is removed from absorption zone 16 via line 18 and recovered. A hydrogen-rich gas having a reduced concentration of hydrogen sulfide is removed from absorption zone 16 via line 19 and is admixed with a hereinafter described hydrogen rich stream provided via line 41 and the resulting admixture is carried via line 20 and introduced into compressor 21. A compressed hydrogen-rich recycle gas stream is removed from compressor 21 via line 22 and a portion is carried via lines 24 and 3 and introduced into hydrocracking reaction zone 4 as hereinabove described. Another portion is carried via lines 22 and 23 and introduced into hot vapor liquid stripper 6. A middle distillate hydrocarbonaceous feedstock is introduced into the process via line 27 and is admixed with a hydrogen make-up gas provided via line 28 and the resulting admixture is carried via line 29 and introduced into hydrodesulfurization zone 30. A resulting hydrodesulfurized hydrocarbonaceous stream is removed from hydrodesulfurization zone 30 via line 31 and is contacted with an aqueous stream provided via line 32 and the resulting admixture is carried via line 33 and introduced into heat exchanger 34. A resulting cooled and partially condensed stream is removed from heat exchanger 34 via line 35 and introduced into cold vapor liquid separator 36. An aqueous stream containing inorganic compounds is removed from cold vapor liquid separator 36 via line 37 and recovered. A hydrogen rich gaseous stream is removed from cold vapor liquid separator 36 via line 39 and introduced into compressor 40. A resulting hydrogen-rich gaseous stream is removed from compressor 40, carried via line 41 and admixed with a hydrogen-rich gaseous stream having a reduced concentration of sulfur provided via line 19 as hereinabove described. A liquid hydrocarbonaceous stream is removed from cold vapor liquid separator 13 via line 25 and a liquid hydrocarbonaceous stream is removed from cold vapor liquid separator 36 via line 38 and the resulting admixture thereof is carried via line 26 and introduced into a fractionation zone (not shown).

The process of the present invention is further demonstrated by the following illustrative embodiment. This illustrative embodiment is, however, not presented to unduly limit the process of this invention, but to further illustrate the advantage of the hereinabove-described embodiment. The following data were not obtained by the actual performance of the present invention but are considered prospective and reasonably illustrative of the expected performance of the invention.

ILLUSTRATIVE EMBODIMENT

A feedstock containing a kerosene and gas oil blend in an amount of 31.2 mass units and having the characteristics presented in Table 1 and a make-up hydrogen rich gaseous stream is introduced into a hydrodesulfurization reaction zone containing hydrodesulfurization catalyst and operating at a pressure of 5.6 MPa (800 psig) and a temperature of 349° C. (660° F.) to produce a hydrodesulfurized effluent containing liquid hydrocarbons having a reduced sulfur concentration, and a hydrogen rich gaseous stream which is compressed to a pressure of 13.9 MPa (2000 psig) and is introduced into the hereinafter described hydrocracking zone.

Another feedstock containing a vacuum gas oil and an atmospheric gas oil blend in an amount of 100 mass units and having the characteristics presented in Table 1 and the hereinabove described compressed hydrogen rich gaseous stream is introduced into a hydrocracking zone containing hydrocracking catalyst and operating at a pressure of 13.9 MPA (2000 psig) and a temperature of 400° C. (750° F.) to produce a hydrocracking zone effluent containing kerosene and diesel boiling range hydrocarbons, and unconverted hydrocarbons. The hydrocracking zone effluent is introduced into a hot vapor liquid separator having hydrogen stripping and operating at a pressure of 13.6 MPa (1950 psig) and a temperature of 393° C. (740° F.) to provide a vaporous stream containing hydrocarbons and hydrogen, and a liquid hydrocarbonaceous stream which is recycled to the hydrocracking zone. The vaporous stream containing hydrocarbons and hydrogen is cooled, partially condensed and introduced into a cold vapor liquid separator maintained at a temperature of 49° C. (120° F.) to produce a hydrogen rich gaseous recycle stream and a liquid hydrocarbonaceous stream containing kerosene and diesel boiling range hydrocarbons. The hydrogen rich gaseous recycle stream and the compressed hydrogen rich gaseous stream are introduced into the hydrocracking zone as hereinabove described. The resulting net liquid streams from the hydrodesulfurization zone and the hydrocracking zone are introduced into a fractionation zone to produce 50.5 mass units of diesel boiling range hydrocarbons having a sulfur concentration less than 50 wppm, 59.2 mass units of kerosene boiling range hydrocarbons having a sulfur concentration less than 50 wppm, 12.9 mass units of naphtha and 8 mass units of $C_1$-$C_6$ hydrocarbons.

TABLE 1

| FEEDSTOCK ANALYSIS | | |
|---|---|---|
| | VACUUM GAS OIL/ ATMOSPHERIC GAS OIL BLEND | KEROSENE/GAS OIL BLEND |
| Specific Gravity | 0.881 | 0.824 |
| Sulfur, weight percent | 0.53 | 0.18 |
| Nitrogen, wppm | 846 | 300 |
| Distillation, ° C. (° F.) | | |
| IBP | 165 (330) | 110 (230) |
| EP | 504 (940) | 315 (600) |

The foregoing description, drawing and illustrative embodiment clearly illustrate the advantages encompassed by the process of the present invention and the benefits to be afforded with the use thereof.

What is claimed is:

1. An integrated process for the production of low sulfur diesel which process comprises:

a) reacting a distillate hydrocarbon feedstock having a boiling range greater than about 149° C. (300° F.) and a make-up hydrogen rich gaseous stream having a first pressure in a hydrodesulfurization reaction zone containing hydrodesulfurization catalyst to produce a hydrodesulfurization reaction zone effluent stream comprising diesel boiling range hydrocarbons having a reduced concentration of sulfur, and hydrogen;

b) reacting a distillate hydrocarbon feedstock with hydrogen at a second pressure in a hydrocracking zone containing hydrocracking catalyst to produce a hydrocracking zone effluent stream comprising lower boiling hydrocarbons;

c) compressing at least a portion of the hydrogen produced in step a) to a second pressure;

d) introducing at least a portion of the hydrogen produced in step c) into the hydrocracking zone of step b); and e) recovering diesel boiling range hydrocarbons having a reduced concentration of sulfur;

wherein said make-up hydrogen rich gaseous stream has not been reacted in said hydrocracking zone before it is reacted in said hydrodesulfurization reaction zone.

2. The process of claim 1 wherein the hydrocarbonaceous feedstock in step b) boils in the range from about 315° C. (600° F.) to about 565° C. (1050° F.).

3. The process of claim 1 wherein the distillate hydrocarbon feedstock boiling in the range greater than about 149° C. (300° F.) boils in the range from about 149° C. (300° F.) to about 399° C. (750° F.).

4. The process of claim 1 wherein the hydrodesulfurization reaction zone is operated at conditions including a pressure from about 3.5 MPa (500 psig) to about 10.5 MPa (1500 psig) and a temperature from about 204° C. (400° F.) to about 482° C. (900° F.).

5. The process of claim 1 wherein the hydrocracking zone is operated at conditions including a pressure from about 7.0 MPa (1000 psig) to about 11.3 MPa (2500 psig) and a temperature from about 260° C. (500° F.) to about 426° C. (800° F.).

6. The process of claim 1 wherein the second pressure in step b) is at least 50% higher than the first pressure of step a).

7. The process of claim 1 wherein diesel boiling range hydrocarbons recovered in step e) contain less than about 100 ppm sulfur.

8. An integrated process for the production of low sulfur diesel which process comprises:

a) reacting a distillate hydrocarbon feedstock having a boiling range greater than about 149° C. (300° F.) and a make-up hydrogen rich gaseous stream having a first pressure in a hydrodesulfurization reaction zone containing hydrodesulfurization catalyst and operated at conditions including a pressure from about 3.5 MPa (500 psig) to about 10.5 MPa (1500 psig) and a temperature from about 204° C. (400° F.) to about 482° C. (900° F.) to produce a hydrodesulfurization reaction zone effluent stream comprising diesel boiling range hydrocarbons having a reduced concentration of sulfur, and hydrogen;

b) reacting a distillate hydrocarbon feedstock with hydrogen at a second pressure in a hydrocracking zone containing hydrocracking catalyst and operated at conditions including a pressure from about 7.0 MPa (1000 psig) to about 17.3 MPa (2500 psig) and a temperature from about 260° C. (500° F.) to about 426° C. (800° F.) to produce a hydrocracking zone effluent stream comprising lower boiling hydrocarbons;

c) compressing at least a portion of the hydrogen produced in step a) to a second pressure;

d) introducing at least a portion of the hydrogen produced in step c) into the hydrocracking zone of step b);

e) recycling a liquid hydrocarbonaceous portion of said hydrocracking zone effluent to the hydrocracking zone; and (f) recovering diesel boiling range hydrocarbons having a reduced concentration of sulfur;

wherein said make-up hydrogen rich gaseous stream has not been reacted in said hydrocracking zone before it is reacted in said hydrodesulfurization reaction zone.

9. The process of claim 8 wherein the hydrocarbonaceous feedstock in step b) boils in the range from about 315° C. (600° F.) to about 565° C. (1050° F.).

10. The process of claim 8 wherein the distillate hydrocarbon feedstock boiling in the range greater than about 149° C. (300° F.) boils in the range from about 149° C. (300° F.) to about 399° C. (750° F.).

11. The process of claim 8 wherein the second pressure in step b) is at least 50% higher than the first pressure of step a).

12. The process of claim 8 wherein diesel boiling range hydrocarbons recovered in step e) contain less than about 100 ppm sulfur.

13. An integrated process for the production of low sulfur diesel which process comprises:

a) reacting a distillate hydrocarbon feedstock boiling in the range from about 149° C. (300° F.) to about 399° C. (750° F.) and a make-up hydrogen rich gaseous stream having a first pressure in a hydrodesulfurization reaction zone containing hydrodesulfurization catalyst and operated at conditions including a pressure from about 3.5 MPa (500 psig) to about 10.5 MPa (1500 psig) and a temperature from about 204° C. (400° F.) to about 482° C. (900° F.) to produce a hydrodesulfurization reaction zone effluent stream comprising diesel boiling range hydrocarbons having a reduced concentration of sulfur, and hydrogen;

b) reacting a distillate hydrocarbon feedstock boiling in the range from about 315° C. (600° F.) to about 565° C. (1050° F.) with hydrogen at a second pressure in a hydrocracking zone containing hydrocracking catalyst and operated at conditions including a pressure from about 7.0 MPa (1000 psig) to about 17.3 MPa (2500 psig) and a temperature from about 260° C. (500° F.) to about 426° C. (800° F.) to produce a hydrocracking zone effluent stream comprising lower boiling hydrocarbons;

c) compressing at least a portion of the hydrogen produced in step a) to a second pressure;

d) introducing at least a portion of the hydrogen produced in step c) into the hydrocracking zone of step b); and e) recovering diesel boiling range hydrocarbons having a reduced concentration of sulfur;

wherein said make-up hydrogen rich gaseous stream has not been reacted in said hydrocracking zone before it is reacted in said hydrodesulfurization reaction zone.

14. The process of claim 13 wherein the second pressure in step b) is at least 50% higher than the first pressure of step a).

15. The process of claim 13 wherein diesel boiling range hydrocarbons recovered in step e) contain less than about 100 ppm sulfur.

16. The process of claim 1 further including recycling a liquid hydrocarbonaceous portion of said hydrocracking zone effluent to the hydrocracking zone.

17. The process of claim 13 further including recycling a liquid hydrocarbonaceous portion of said hydrocracking zone effluent to the hydrocracking zone.

* * * * *